United States Patent [19]

Lonardo

[11] 4,137,017

[45] Jan. 30, 1979

[54] SUBMERSIBLE DEEP WELL PUMP

[76] Inventor: Vincent P. Lonardo, 5890 Salt Springs Rd., Girard, Ohio 44420

[21] Appl. No.: 812,320

[22] Filed: Jul. 1, 1977

[51] Int. Cl.[2] ..... F04B 47/00; F04B 21/04

[52] U.S. Cl. ..... 417/431; 417/559

[58] Field of Search ..... 417/254, 259, 260, 265, 417/267, 431, 443, 444, 459, 460, 526–528, 552–554, 559

[56] References Cited

U.S. PATENT DOCUMENTS

| | | | |
|---|---|---|---|
| 191,448 | 5/1877 | Lewis | 417/459 |
| 353,897 | 12/1886 | Tengue | 417/443 |
| 356,750 | 2/1887 | Cully | 417/563 |
| 445,962 | 2/1891 | Montgomery | 417/563 |
| 747,728 | 12/1903 | Kirk | 417/456 |
| 814,312 | 3/1906 | Nevins | 417/448 |
| 1,065,225 | 6/1913 | Conningham | 417/528 |
| 1,785,834 | 12/1930 | Kilgore | 417/554 |
| 1,817,659 | 8/1931 | Weaver | 417/431 |
| 1,909,454 | 5/1933 | Brunner | 417/460 |
| 2,262,128 | 11/1941 | Zehner | 417/487 |
| 2,326,378 | 8/1943 | McConnollie | 417/526 |
| 3,945,774 | 3/1976 | Doan | 417/554 |

*Primary Examiner*—William L. Freeh

*Attorney, Agent, or Firm*—Webster B. Harpman

[57] ABSTRACT

A submersible deep well pump having two interconnecting chambers slidably receiving a movable hollow piston, each chamber having a check valve wherein movement of the piston alternately opens and closes the check valves allowing liquid displaced by the piston to be progressively moved through the chambers into the hollow piston and to the surface.

2 Claims, 2 Drawing Figures

SUBMERSIBLE DEEP WELL PUMP

BACKGROUND OF THE INVENTION (1). Field of the Invention

This invention relates to deep well pumps of the type normally employed to pump oil from wells.

(2). Description of the Prior Art

Prior structures of this type have utilized pistons for displacing the liquid and piston pumps have been known in the art including the use of check valves. See for example U.S. Pat. Nos. 969,127, Pat. No. 2,383,934 and U.S. Pat. No. 411,680.

SUMMARY OF THE INVENTION

Figure 1:
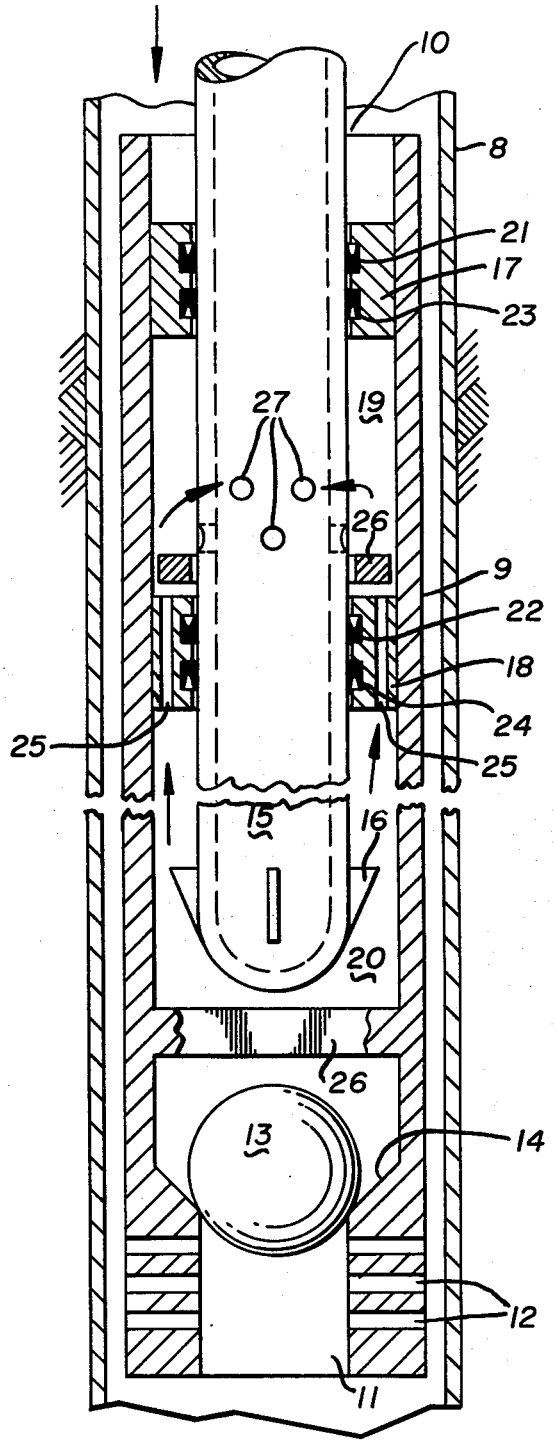
FIG. 1 is a cross sectional view of a pump with the piston in its downstroke position.

A submersible deep well pump has a movable hollow piston slidably engaging two chambers each with a check valve actuated by the positive or negative pressure of the displaced oil as the hollow piston moves forcing the oil into and through the hollow piston body to the surface by way of piping attached to the hollow piston which also moves the hollow piston.

DESCRIPTION OF THE PREFERRED EMBODIMENT

In its preferred form the submersible deep well pump is shown in a casing 8 in an oil well and comprises a cylinder 9 having open upper and lower ends 10 and 11. Apertures 12 are formed in the cylinder 9 adjacent the lower end 11. A spherical check valve 13 is located in an area of reduced diameter 14 in the lower end of the cylinder 9. One or more projections 16 are located on the side of the hollow piston 15 adjacent its lower end. A pair of annular body members 17 and 18 are located in vertical spaced relation in the cylinder 9 forming two chambers 19 and 20 therein. Annular channels 21 and 22 are formed in the inner surface of the annular body members 17 and 18 respectively and position resilient seals 23 and 24 for sealing engagement with said hollow piston 15. The annular body member 18 has a plurality of bores 25 therethrough. A ring valve 26 is movably positioned in the chamber 19 so as to engage and close said bores 25. A bar 26 is positioned transversely of the cylinder 9 and spaced above the spherical check valve 13.

Figure 2:
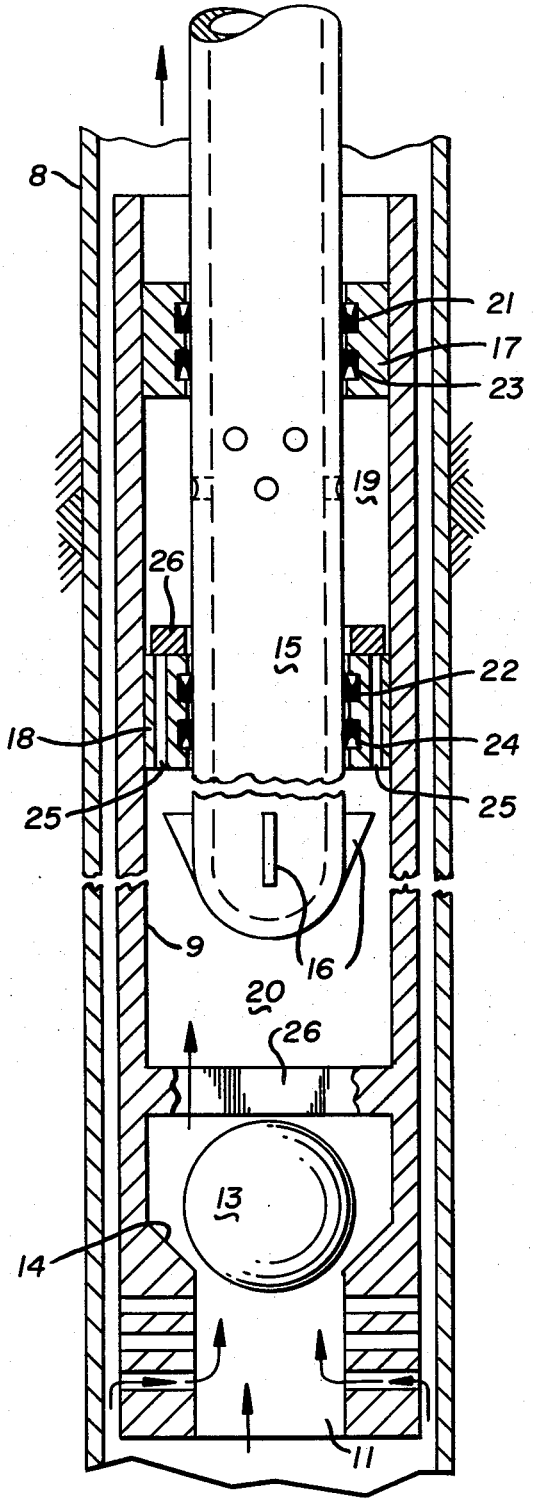
FIG. 2 is a cross sectional view of the pump with the piston in its upstroke position.

In the operation of the pump the upward movement of the hollow piston 15 as seen in FIG. 2 causes a decrease of pressure within the chamber 20 opening the spherical check valve 13 drawing in oil through the apertures 12 and the bottom 11 to fill the chamber 20. Fluid holds the check ring valve 26 closed against the bores 25.

As seen in FIG. 1, the downward movement of the hollow piston 15 into the chamber 20 increases the pressure therein closing said spherical check valve 13 and opens said check ring valve 26 so that the displaced oil moves into the chamber 19 and through apertures 27 into the hollow piston 15. The hollow piston 15 is attached to and reciprocated by a string of piping, not shown, extending to the surface.

It will thus be seen that receiprocal motion imparted the hollow piston 15 of the submersible deep well pump by the string of communicating piping to which it is attached moves oil from the well on both its up and down strokes because displacement in the chamber 20 on the downstroke of the hollow piston 15 moves oil up through the ring valve 26 and into the hollow piston 15 and therefore into the piping to which it is attached and which piping extends to the surface. On the upstroke the hollow piston 15 and the piping moves upwardly and lifts the column of oil therein and the lifted oil runs out of the top of the piping.

The submersible deep well pump is of simple construction and may be easily assembled to the string of piping and lowered into the well. The deep well pump as disclosed herein has an additional function. By moving the hollow piston upwardly until the apertures 27 are above the annular member 18 and/or the upper end 10 of the cylinder 9, steam or high temperature solvent or the like may be introduced at a desirable location in the oil sand so as to remove paraffin build up and increase the flow of oil to the pump.

Although but one embodiment of the present invention has been illustrated and described, it will be apparent to those skilled in the art that various changes and modifications may be made therein without departing from the spirit of the invention and having thus described my invention what I claim is.

I claim:

1. A submersible deep well pump comprising a vertically disposed cylinder open at its upper and lower ends, vertically spaced apertured means in said cylinder defining upper and lower chambers, upwardly opening check valves in two of said chamber defining means, a hollow piston positioned in said cylinder and slidably engaged in two of said apertured chamber defining means so as to be movable partially into and out of the lower one of said chambers, said hollow piston having apertures therein communicating with the upper one of said chambers whereby movement of said piston downwardly into said lower chamber displaces fluid therein upwardly through one of said check valves and into said upper chamber and movement of said piston upwardly in said lower chamber moves fluid into said lower chamber upwardly through the other one of said check valves, said vertical spaced apertured means comprising an area of reduced diameter at the lower end of said cylinder and forming a seat for one of said check valves and a pair of annular members, one positioned adjacent said upper end of said cylinder and the other positioned inwardly of the ends of said cylinder, a check ring valve on said other annular member arranged to close bores therethrough, sidewardly extending projections formed adjacent the lower end of said hollow piston so as to engage said other annular member and prevent said hollow piston from moving through the same.

2. A submersible deep well pump comprising a vertically disposed cylinder open at its upper and lower ends, vertically spaced apertured means in said cylinder defining upper and lower chambers, upwardly opening check valves in two of said chamber defining means, a hollow piston positioned in said cylinder and slidably engaged in two of said apertured chamber defining means so as to be movable partially into and out of the lower one of said chambers, said hollow piston having apertures therein communicating with the upper one of said chambers whereby movement of said piston downwardly into said lower chamber displaces fluid therein upwardly through one of said check valves and into said upper chamber and movement of said piston upwardly in said lower chamber moves fluid into said lower chamber upwardly through the other one of said check valves, said hollow piston being of a length greater than the combined lengths of said chambers in said cylinder so that the portion of said hollow piston having said apertures therein can be moved upwardly to place said apertures above said chambers and cylinder to permit a fluid to be introduced into a well therethrough.

* * * * *